US005662133A

United States Patent [19]

Guido, Jr.

[11] Patent Number: 5,662,133

[45] Date of Patent: Sep. 2, 1997

[54] CANVAS HOLD-DOWN SYSTEM AND METHOD

[76] Inventor: Anthony L. Guido, Jr., 510 N. Davis Rd., Elma, N.Y. 14059

[21] Appl. No.: 595,399

[22] Filed: Feb. 5, 1996

[51] Int. Cl.[6] ..... E04H 15/64

[52] U.S. Cl. ..... 135/119; 135/907; 24/313; 24/3.6

[58] Field of Search ..... 135/115, 119, 135/120.1, 120.3, 907, 124, 125, 98, 99; 24/3.13, 3.6, 301, 200

[56] References Cited

U.S. PATENT DOCUMENTS

| | | | |
|---|---|---|---|
| 2,095,340 | 10/1937 | Meyer | 24/198 |
| 2,140,164 | 12/1938 | Moffatt | 24/198 |
| 2,212,862 | 8/1940 | Hirsh | 24/198 |
| 2,233,397 | 3/1941 | Bloom | 227/49 |
| 3,161,931 | 12/1964 | Zif | 24/200 |
| 3,452,401 | 7/1969 | Trent | 24/301 |
| 3,970,227 | 7/1976 | Hardy | 24/3.6 X |
| 4,099,533 | 7/1978 | Gillis | 135/119 X |
| 4,193,413 | 3/1980 | Watts et al. . | |
| 4,516,418 | 5/1985 | Cuttler | 24/3.6 X |
| 4,827,958 | 5/1989 | Cantwell et al. . | |
| 5,069,050 | 12/1991 | Chen | 24/3.6 X |
| 5,197,504 | 3/1993 | Howe . | |
| 5,261,436 | 11/1993 | Funk . | |
| 5,421,355 | 6/1995 | Cantwell | 135/119 X |

FOREIGN PATENT DOCUMENTS

0490413A1 6/1992 European Pat. Off. .

OTHER PUBLICATIONS

Data sheet of Sunnex AB of Sweden—"Fjong rubber–straps".

*Primary Examiner*—Lanna Mai

*Attorney, Agent, or Firm*—Hodgson, Russ, Andrews, Woods & Goodyear, LLP

[57] ABSTRACT

A system for holding canvas to a frame of a portable shelter or the like. An intermediate portion of a strip is attached to the canvas and the end portions are attached to a clip to form a loop which receives an endless elastomeric band which is attachable to a pair of spaced knobs on a frame member. At least one of the end portions is releasably attachable to the clip whereby the customer may easily replace a broken band.

15 Claims, 1 Drawing Sheet

CANVAS HOLD-DOWN SYSTEM AND METHOD

The present invention relates generally to a system and method for holding canvas, vinyl, or other fabric to frame members of, for example, portable shelters, awnings, or the like.

A portable shelter comprises a frame including a number of rigid frame members of tempered aluminum pipe or the like which are joinable at the site of erection and a vinyl or canvas covering or the like which is attachable to frame members at the site. References to canvas in this specification, unless otherwise noted, are meant to include vinyl and other suitable fabric materials. It is considered desirable to erect such a portable shelter or the like quickly and easily and with the canvas tightly attached so that it does not hold water. A system which has been used for holding the canvas to the frame members is illustrated generally at 5 in FIG. 1. This system 5 includes an elastomeric band 6 which is permanently attached to the canvas 7 by means of a loop 8 of canvas or other fabric material the end portions of which are sewn to the canvas 7 as by stitches, illustrated at 9. Such a system undesirably requires the customer to return the product, if the band breaks, for its replacement. Further, since this system provides for attachment of the band to the frame by means of a single islet or knob on the frame, and since the system is constructed to tightly or tautly attach the canvas, it may not be as easy as desired for a customer to attach the band to the islet.

Sunnex AB of Sweden has provided clips having a pair of posts one of which is attached to an eye of a truck cover, and the other post receives one end of an elongate elastic rubber strap, also provided commercially by Sunnex AB, which is used to pull the cover tautly into position, and the other end is received in a hook or knob on the truck. The straps are identified as Fjong-straps. The straps have also been used without the clips by insertion of the straps in the eyes with the straps held therein by means of T-shaped ends, and the other ends are received in hooks or knobs on a truck. Such a system, which is non-permanently attached to truck covers, is not suitable for portable shelters and the like.

U.S. Pat. No. 5,261,436 to Funk discloses a tent structure wherein fabric is attached to a connection member by means of an ear associated with the connection member and which has an eye for receiving a hook, as best seen in FIG. 3 thereof. A webbing loop is sewn to and extends from the tent. An elastic shock cord connects the hook with the loop. Similarly as for the system illustrated in FIG. 1 of the drawings, sewing work is required in order to replace a broken shock cord. Thus, the Funk system must also undesirably have to be returned by the customer to replace a broken shock cord.

Other patents which may be of interest to this application are U.S. Pat. Nos. 2,095,340; 2,140,164; 2,212,862; 2,233,397; 4,193,413; 4,827,958; and 5,197,504.

It is accordingly an object of the present invention to provide a canvas or awning hold-down system which allows the band to be easily replaced by the customer without the necessity of returning the canvas to which the system is attached.

It is a further object of the present invention to provide such a system which allows the canvas to be easily as well as quickly attached to the frame tightly.

In order to allow replacement easily of the band by a customer, in accordance with the present invention, an intermediate portion of a strip is sewn or otherwise suitably attached to the canvas and the end portions are attached (at least one end portion releasably attached) to a clip to form a loop. The band is contained within the loop. To replace the band, an end portion of the strip is released from the clip, the band removed and replaced, and the end portion re-attached to the clip.

In order to allow the band to be more easily attached tightly to the frame, in accordance with the present invention, a pair of spaced islets or knobs are placed on the respective frame member for receiving the band.

The above and other objects, features, and advantages of the present invention will be apparent in the following detailed description of the preferred embodiment thereof when read in conjunction with the appended drawings wherein the same reference numerals denote the same or similar parts throughout the several views.

DETAILED DESCRIPTION OF THE PREFERRED EMBODIMENT

Figure 1:
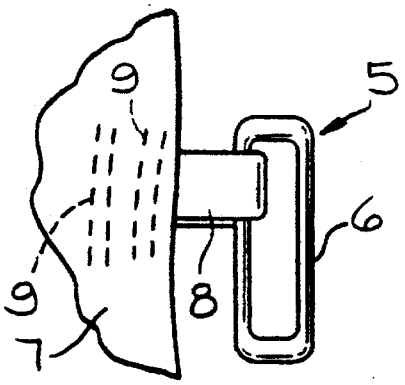
FIG. 1 PRIOR ART
FIG. 1 is a plan view illustrating a canvas hold-down system in accordance with the prior art.
Figure 2:
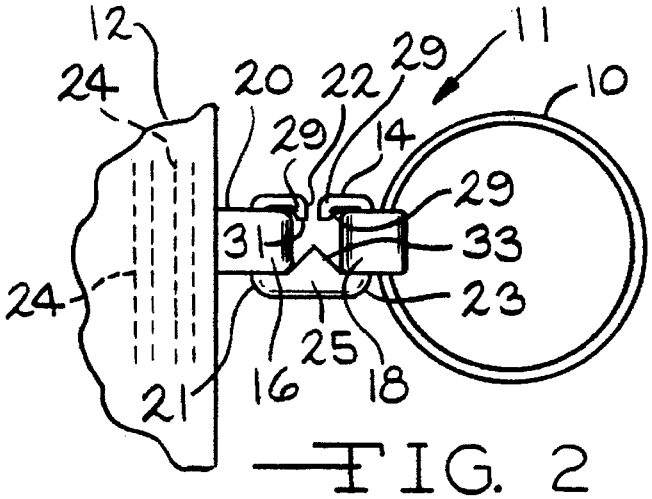
FIG. 2 is a plan view of a canvas hold-down system which embodies the present invention.
Figure 3:
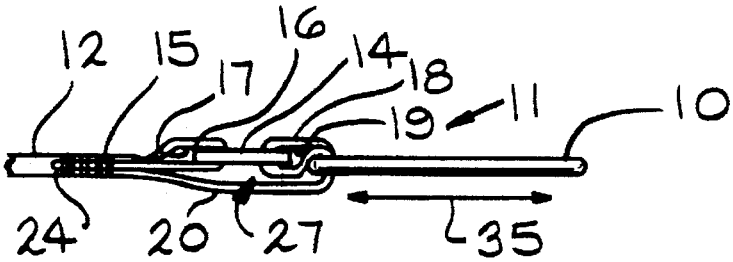
FIG. 3 is a side view of the system of FIG. 2.
Figure 4:
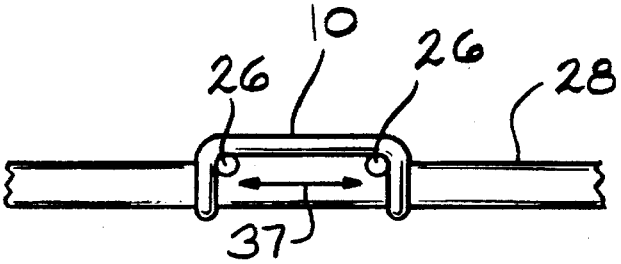
FIG. 4 is a front view illustrating attachment of the band of the system of FIG. 2 to a frame member.

Referring to FIGS. 2 and 3, there is shown generally at 11 a system for tightly holding canvas 12 to a frame member, illustrated at 28 in FIG. 4, of a frame of, for example, a portable shelter. While described relative to a portable shelter, it should be understood that the present invention may have various other applications such as for holding down awnings. A number of such systems may be provided along the edges of the canvas 12 to secure the canvas at various points on the frame. The system 11 includes an endless circular stretchable rubber or elastomeric band 10 (which may also be circular in cross-section and which may be similar to a vacuum cleaner belt) which is releasably attachable to the canvas 12 by means of an elongate strip 20 of fabric and a clip 14, as discussed hereinafter.

An intermediate portion 15 of the strip 20 is sewn as by stitches, illustrated at 24, or otherwise suitably attached to the canvas 12. Each end portion 16 and 18 of the strip 20 is doubled back on itself and sewn to itself to define eyes 17 and 19 respectively.

The clip 14 may be composed of a generally flat piece of steel or other suitable material and comprises a pair of posts 21 and 23 joined by a portion 25 at one end of each post for releasably receiving the eyes 17 and 19 respectively so as to define a closed loop, illustrated at 27. The other ends of the posts are not connected to each other so as to define a slot, illustrated at 22, which allows passage of the eyes 17 and 19 onto the respective posts 21 and 23. In order to retain the eyes on the posts, clip portions 29 extend from the post ends toward the slot 22 and have portions 31 which extend inwardly (toward the opposite post ends) adjacent the slot 22. The portion 25 has a triangular-shaped portion 33 which is between the posts and which extends inwardly (toward the slot 22 and toward portions 31). The spacing between the portion 33 and each of the portions 31 is desirably narrower than the width of the strip 20 so that the strip is retained against movement through the slot 22. A suitable clip may be the previously-discussed Sunnex clip. It should however be understood that other suitable clips may be provided for releasably attaching the ends of the strip 20, and such other clips are meant to come within the present invention.

Figure 5:
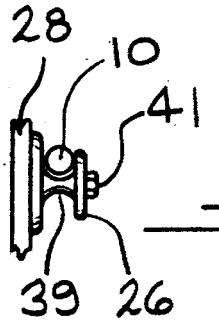
FIG. 5 is a side view thereof.

The band 10 is received within the closed loop 27 and is passed around a pair of spaced islets or knobs or buttons, illustrated at 26 in FIG. 4, on the frame member 28 for tautly or tightly securing the canvas 12 thereto. Each knob 26 may desirably have a circumferential groove, illustrated at 39 in FIG. 5, for snugly receiving the band 10. The knob 26 may be attached to the frame member 28 by screw 41 or other suitable means. The provision of a pair of spaced knobs 26 allows the stretchable band 10 to be more easily secured tightly to the frame member 28 by looping about the pair of knobs than if only a single knob were provided. The spacing between the knobs and the size of the band are selected to provide the desired tautness. For example, the band 10 may have a relaxed diameter, illustrated at 35, of perhaps about 3 inches for engaging knobs 26 which are spaced apart a distance, illustrated at 37, of perhaps about 4 inches.

Since only one eye need be released from the respective clip post in order to allow removal of the band 10, it should be understood that one of the eyes may be permanently attached to the clip.

In order to attach the canvas 12 to a frame, the band 10 of each system 11 is stretched and disposed to be received in the grooves 39 of the knobs 26, pulling the canvas tautly, after the frame has been fully or partially erected. If a band were to break, it may be easily replaced by the customer by releasing one of the eyes 17 and 19 from its respective post, removing the band and replacing it with another, then re-attaching the eye to the respective post. Thus, it is not necessary to return the canvas to the shop for band replacement.

It should be understood that, while the present invention has been described in detail herein, the invention can be embodied otherwise without departing from the principles thereof, and such other embodiments are meant to come within the scope of the present invention as defined by the appended claims.

What is claimed:

1. In combination with a fabric, means for detachably attaching the fabric to a frame member, said attaching means comprising at least one clip, an elongate strip having an intermediate portion which is attached to the fabric and a pair of end portions, means for attaching said end portions to said clip to thereby define a loop with at least one of said end portions being releasably attachable to said clip, a band composed of elastomeric material and receivable within the loop for engaging a frame member whereby the band is removable for replacement by releasing said at least one end portion from said clip.

2. A combination according to claim 1 wherein said fabric is canvas and said frame member is part of a frame for a shelter.

3. A combination according to claim 1 wherein said strip is sewn to the fabric.

4. A combination according to claim 1 wherein said band has a diameter of about 3 inches for engaging a pair of knobs on a frame member which are spaced apart about 4 inches.

5. A combination according to claim 1 wherein said end portions of said strip are formed to define eyes, and said clip has a pair of posts for removably receiving said eyes respectively and means for retaining said eyes on said posts respectively.

6. In combination with a fabric, a frame having at least one frame member, and means for detachably attaching the fabric to the frame member comprising at least one clip, an elongate strip having an intermediate portion which is attached to the fabric and a pair of end portions attached to said clip with at least one of said end portions being releasably attachable to said clip thereby defining a loop, a band composed of elastomeric material and received within the loop for engaging the frame member whereby the band is removable for replacement by releasing said at least one end portion from said clip.

7. A combination according to claim 6 wherein said fabric is canvas and said frame and said fabric form a portable shelter.

8. A combination according to claim 6 further comprising a pair of spaced apart knobs on said frame member for receiving said band.

9. A combination according to claim 8 wherein said band has a diameter of about 3 inches and said knobs are spaced apart a distance of about 4 inches.

10. A combination according to claim 6 wherein said strip is sewn to the fabric.

11. A combination according to claim 6 wherein said end portions of said strip are formed to define eyes, and said clip has a pair of posts for removably receiving said eyes respectively and means for retaining said eyes on said posts respectively.

12. A method of detachably attaching a fabric to at least one frame member comprising (a) attaching an intermediate portion of at least one strip to the fabric, (b) attaching end portions of the strip to a clip to form a loop while disposing a band composed of elastomeric material to be received within the loop and so that at least one of the end portions is releasably attachable to the clip whereby the band is removable for replacement by releasing the at least one end portion from the clip, and (c) engaging the frame member with the band.

13. A method according to claim 12 further comprising selecting the fabric and frame to be canvas and a frame for a portable shelter.

14. A method according to claim 12 further comprising stretching the band to tightly engage a pair of spaced knobs on the frame member.

15. A method according to claim 12 further comprising selecting the strip so that the end portions thereof are formed to define eyes, and removably inserting posts of the clip in the eyes respectively.

* * * * *